US007591321B2

(12) United States Patent
Whitsitt et al.

(10) Patent No.: US 7,591,321 B2
(45) Date of Patent: Sep. 22, 2009

(54) ZONAL ISOLATION TOOLS AND METHODS OF USE

(75) Inventors: John R. Whitsitt, Houston, TX (US); Carlos Araque, Sugar Land, TX (US); David M. Eslinger, Collinsville, OK (US); Philippe Gambier, Houston, TX (US); Dinesh R. Patel, Sugar Land, TX (US); Chad Hardwick, West Columbia, TX (US); Jason K. Jonas, Missouri City, TX (US); Robert Divis, Houston, TX (US); Randolph J. Sheffield, Sugar Land, TX (US); Bryan L. White, Houston, TX (US); Chad Lucas, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 272 days.

(21) Appl. No.: 11/308,617

(22) Filed: Apr. 12, 2006

(65) Prior Publication Data

US 2006/0260820 A1 Nov. 23, 2006

Related U.S. Application Data

(60) Provisional application No. 60/594,628, filed on Apr. 25, 2005.

(51) Int. Cl.
*E21B 33/12* (2006.01)

(52) U.S. Cl. ..... 166/387; 166/187; 277/333

(58) Field of Classification Search ..... 166/187, 166/387; 277/333
See application file for complete search history.

(56) References Cited

U.S. PATENT DOCUMENTS 3,437,142 A * 4/1969 Conover ..... 166/277
3,524,503 A 8/1970 Baker
3,581,816 A 6/1971 Malone
3,604,732 A 9/1971 Malone
3,606,924 A * 9/1971 Malone ..... 166/187
4,191,383 A * 3/1980 Baker et al. ..... 277/312
4,349,204 A 9/1982 Malone
4,403,660 A 9/1983 Coone
4,420,159 A * 12/1983 Wood ..... 277/333

(Continued)

FOREIGN PATENT DOCUMENTS

EP 0589687 A3 3/1994
EP 1479871 A1 11/2004
GB 2406593 A 4/2005
WO 2005052308 A1 6/2005
WO 2006020827 A2 2/2006

*Primary Examiner*—Jennifer H Gay
*Assistant Examiner*—Robert E Fuller
(74) *Attorney, Agent, or Firm*—Van Someren, PC; Jeremy P. Welch; James L. Kurka

(57) ABSTRACT

Zonal isolation tools and methods of using same are described. The zonal isolation tools include a wellbore sealing member expandable by fluid pressure to contact a wellbore over an initial contact area, an inflation valve open during expansion of the sealing member to the initial contact area and closed upon the fluid pressure reaching a predetermined setting, a vent between the sealing member and a wellbore annulus adapted to open after the inflation valve is closed, and a compressive load imparted to the sealing member via a linear piston to achieve a sealing point at the leading edge of the sealing member. This abstract allows a searcher or other reader to quickly ascertain the subject matter of the disclosure. It will not be used to interpret or limit the scope or meaning of the claims. 37 CFR 1.72(b).

13 Claims, 7 Drawing Sheets

U.S. PATENT DOCUMENTS 4,492,383 A * 1/1985 Wood ..... 277/333
4,648,448 A 3/1987 Sanford et al.
4,711,301 A * 12/1987 Stringfellow ..... 166/187
4,768,590 A 9/1988 Sanford et al.
4,832,120 A 5/1989 Coronado
4,951,747 A 8/1990 Coronado
5,143,154 A 9/1992 Mody et al.
5,197,542 A 3/1993 Coone
5,205,567 A 4/1993 Quinlan et al.
5,271,469 A 12/1993 Brooks et al.
5,439,053 A * 8/1995 Eslinger et al. ..... 166/187
6,640,893 B1 11/2003 Rummel et al.
6,752,205 B2 6/2004 Kutac et al.
2003/0098153 A1 5/2003 Serafin
2005/0072579 A1 4/2005 Gambier
2005/0161232 A1 7/2005 Patel et al.

* cited by examiner

ZONAL ISOLATION TOOLS AND METHODS OF USE

CROSS-REFERENCE TO RELATED APPLICATIONS

The present application claims priority under 35 U.S.C. § 119(e) to U.S. Provisional Application Ser. No. 60/594,628, filed Apr. 25, 2005, incorporated by reference herein in its entirety. The inventions of the present application are related to assignee's pending patent application Ser. No. 10/763,565 filed Jan. 23, 2004 (68.0418); Ser. No. 10/924,684 filed Aug. 20, 2004 (68.0455); and Ser. No. 11/361,531 filed Feb. 23, 2006 (43.0023).

BACKGROUND OF THE INVENTION

1. Field of Invention

The present invention relates generally to the field of well bore zonal isolation tools and methods of using same in various oil and gas well operations.

2. Related Art

A zonal isolation tool should provide reliable, long-term isolation between two or more subsurface zones in a well. A typical application would be to segregate two zones in an open-hole region of a well, the zones being separated by a layer of low permeability shale in which the zonal isolation tool is placed. A nominal size configuration would be usable in wellbores drilled with an 8-½ inch (21.6 cm) outer diameter bit below 9-⅝ inch (24.5 cm) casing, but the use of zonal isolation tools is not limited to any particular size, or to use in open holes. By segregating open-hole intervals, downhole chokes may be used for production management. Similarly, selective zonal injection may be performed. If distributed temperature sensing is placed in the well, monitoring predictive control is possible.

A conventional completion assembly 10 with a zonal isolation tool 12 is illustrated in FIGS. 1 and 2 for allowing production of two separate flows 4A and 4B from an open hole 3. Assembly 10 may include a production packer 14, a gravel pack packer 16, flow control valves 18, and other components commonly used in downhole completions. Zonal isolation tool 12 may comprise a packer 20, a pair of anchors 22, a pair of polished bore receptacles (PBRs) 24, and an expansion joint 26. Service tools may include a setting string 28 and an isolation string 30.

Most of the current zonal isolation tools are made with an elastomeric membrane for sealing supported on a metallic support carriage structure for mechanical strength. In some constructions, the zonal isolation tools of this design may be composed of an inner sealing element, an integrated mechanical carriage structure, and an outer elastomeric element for sealing. The carriage can be made entirely of a composite material and thus integrates the mechanical support elements within a laminar structure of the composite body. Although these designs decrease extrusion of the inner elastomeric element through the carriage, further problems remain. One problem manifests itself in certain downhole conditions, for example at high temperatures, where the inner elastomeric element may be prone to extrusion through the support carriage structure when inflated. For support carriages having slats, the slats generally provide good protection against extrusion of the underlying elastomer through the slats, however, high friction coefficient between slats may make inflation/deflation difficult at high hydrostatic pressure.

Therefore, while there have been some improvements in zonal isolation tool design, further improvement is desired.

SUMMARY OF THE INVENTION

In accordance with the present invention, zonal isolation tools and methods of use are described that reduce or overcome problems in previously known apparatus and methods.

Zonal isolation tools of the invention comprise:

a) a wellbore sealing member expandable by fluid pressure to contact a wellbore over an initial contact area;

b) an inflation valve open during expansion of the sealing member to the initial contact area and closed upon the fluid pressure reaching a predetermined setting; and c) a vent between the sealing member and a wellbore annulus adapted to open after the inflation valve is closed.

Certain apparatus embodiments comprise d) a linear compression member adapted to impart compressive load on the wellbore sealing member, and thus form a sealing point at or near a leading edge of the wellbore sealing member. The wellbore sealing member of the zonal isolation tools of the invention may comprise an inner sealing element and an outer sealing element. One or both of the inner and outer sealing elements, or portions of each, may comprise an elastomeric material, which may be the same or different for each member or portion thereof. Zonal isolation tools of the invention may comprise means for preventing substantial radial expansion of the sealing member while running the tool in hole, such as bands, screws, snap rings, poppet valves, and the like. The tool may include means for controlling longitudinal location of a leading edge of a final seal to ensure a sealing point at or near a leading edge of the sealing member, such as a slotted metal or composite cylindrical member having a plurality of individual beams, at least some of the beams having notches near the leading edge of the sealing member. The tools of the invention may comprise one or more anti-extrusion members selectively positioned between the slotted cylinder and the inner sealing element, or between the slotted cylinder and the outer sealing element, or in both positions. Zonal isolation tools of the invention may have a venting port located on a low pressure side of the sealing member, useful to vent any gases accumulating between inner and outer sealing elements. Other embodiments may have one or more flow paths, sometimes referred to as shunt tubes, although they need not be tubular, serving to allow flow of fluids such as gravel slurry, injection fluids, and the like through the zonal isolation tool. The flow paths may have an equivalent flow area as the main flow paths in the zonal isolation tool. If a screen pipe is employed, the screen pipe and isolation tool may be on different centers, which may ease any disruption in the flow transition. The zonal isolation tools of the invention may comprise standard non-expandable end connections.

Zonal isolation tools of the invention may comprise a straight pull release mechanism, as well as a connector for connecting an end of the tool to coiled tubing or jointed pipe. Yet other embodiments of the zonal isolation tools of the invention comprise an expandable packer wherein the expandable portion comprises continuous strands of polymeric fibers cured within a matrix of an integral composite tubular body extending from a first non-expandable end to a second non-expandable end of the body. Other embodiments of zonal isolation tools of the invention comprise continuous strands of polymeric fibers bundled along a longitudinal axis of the expandable packer body parallel to longitudinal cuts in a laminar interior portion of the expandable body to facilitate expansion of the expandable portion of the integral composite tubular body. Certain other tool embodiments of the present invention comprise a plurality of overlapping reinforcement members made from at least one of the group consisting of high strength alloys, fiber-reinforced polymers and/or elastomers, nanofiber, nanoparticle, and nanotube reinforced polymers and/or elastomers. Yet other tool embodiments of the present invention include those wherein the reinforcement members have an angled end adjacent a non-expandable first end and adjacent a non-expandable second end to allow expansion of the expandable portion of the sealing member.

Another aspect of the invention are methods of using the inventive tools, one method of the invention comprising:

positioning a zonal isolation tool of the invention in a wellbore between two zones;

inflating the wellbore sealing member by opening an inflation valve to establish an initial sealing area; and axially compressing the wellbore sealing member to achieve a final seal having a point at or near a leading edge of the wellbore sealing member.

Certain method embodiments comprise venting the wellbore sealing member to a wellbore annulus after the inflation valve. Certain embodiments comprise beginning axial compression of the wellbore sealing element using a linear compression member before beginning venting of the wellbore sealing member to the wellbore annulus. Yet another method embodiment comprises axially compressing the wellbore sealing element before closing the inflation valve completely, followed by venting the wellbore sealing element to the wellbore annulus. Other methods of the invention include closing the inflation valve after inflating the wellbore sealing member, and subsequently operating a compressible member to axially compress the wellbore sealing member to a final sealing area. Yet other methods of the invention comprise producing fluid from at least one of the two zones. If two fluids are produced simultaneously, the two fluids may be the same or different in composition, temperature, pressure, and fluid mechanical characteristics, such as viscosity, gravity, and the like. Methods of the invention may comprise controlling the position of a leading edge of the final sealing member.

Another method of the invention comprises:

(a) positioning a zonal isolation tool of the invention in an open-hole wellbore between two zones, and initially inflating (hydroforming) the wellbore sealing member using tubing pressure and then releasing pressure;

(b) compressing the wellbore sealing member using tubing pressure to initiate a cup-type seal in the open-hole wellbore; and (c) using annular differential pressure to fully energize the cup-type seal.

These and other features of the apparatus and methods of the invention will become more apparent upon review of the brief description of the drawings, the detailed description of the invention, and the claims that follow.

BRIEF DESCRIPTION OF THE DRAWINGS

The manner in which the objectives of the invention and other desirable characteristics can be obtained is explained in the following description and attached drawings in which.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

All phrases, derivations, collocations and multiword expressions used herein, in particular in the claims that follow, are expressly not limited to nouns and verbs. It is apparent that meanings are not just expressed by nouns and verbs or single words. Languages use a variety of ways to express content. The existence of inventive concepts and the ways in which these are expressed varies in language-cultures. For example, many lexicalized compounds in Germanic languages are often expressed as adjective-noun combinations, noun-preposition-noun combinations or derivations in Romanic languages. The possibility to include phrases, derivations and collocations in the claims is essential for high-quality patents, making it possible to reduce expressions to their conceptual content, and all possible conceptual combinations of words that are compatible with such content (either within a language or across languages) are intended to be included in the used phrases.

The invention describes zonal isolation tools and methods of using same in wellbores. A "wellbore" may be any type of well, including, but not limited to, a producing well, a non-producing well, an experimental well, and exploratory well, and the like. Wellbores may be vertical, horizontal, any angle between vertical and horizontal, diverted or non-diverted, and combinations thereof, for example a vertical well with a non-vertical component. Although existing zonal isolation tools have been improved over the years, these improved designs have left some challenging problems. One problem manifests itself at in certain downhole conditions, for example high temperatures, where the inner rubber layer may be prone to extrusion through the support carriage structure when inflated. For zonal isolation tools having slats, the slats generally provide good protection against extrusion of the underlying elastomer through the slats, however, after inflation and deflation the slats may experience permanent deformation. Thus, there is a continuing need for zonal isolation tools and methods that address this problem.

Figure 3:
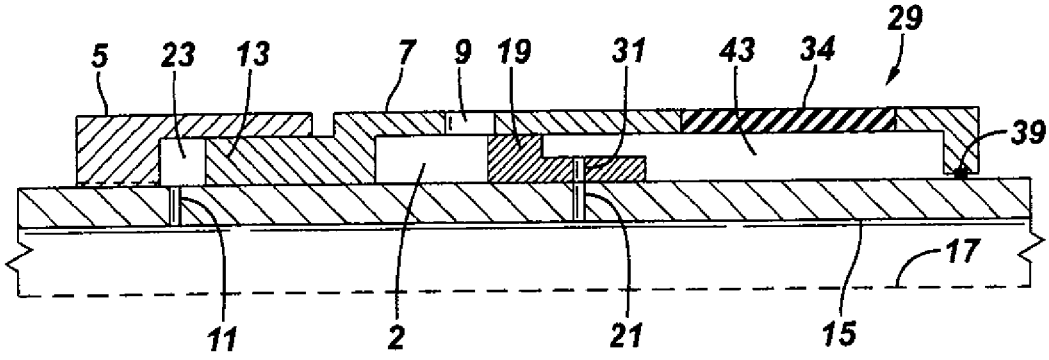
FIG. 3 is a schematic longitudinal side elevation view of a portion of the base structure of the inventive zonal isolation tool of FIG. 1.
Figure 4:
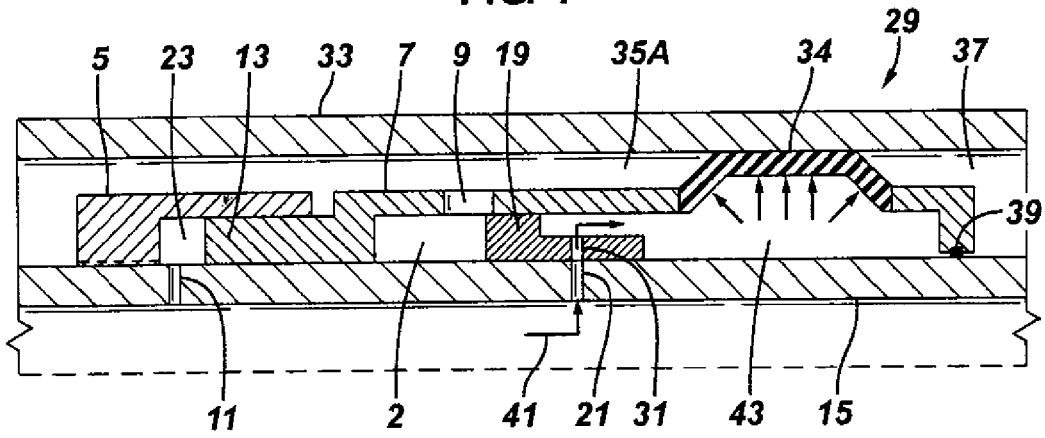
FIG. 4 is a schematic longitudinal side elevation view of a portion of the base structure of the zonal isolation tool of FIG. 1 after inflation pressure has been applied.
Figure 5:
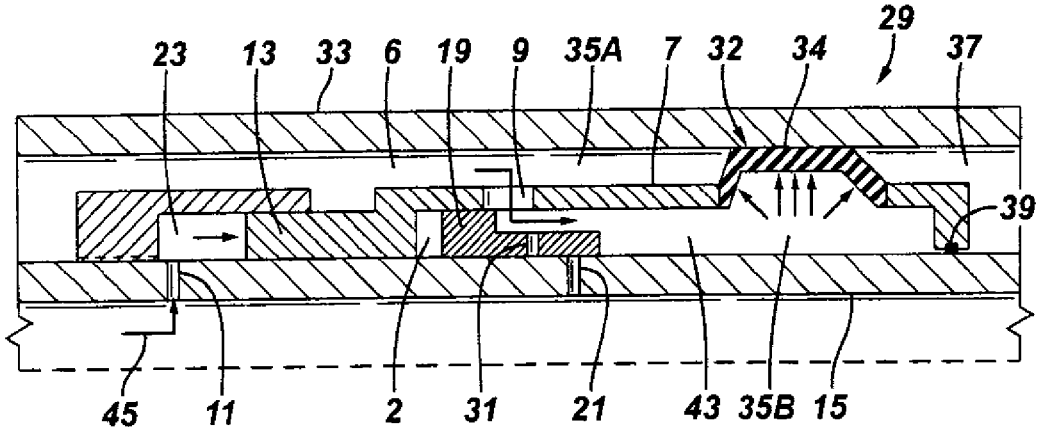
FIG. 5 is a schematic longitudinal side elevation view of a portion of the base structure of the zonal isolation tool of FIG. 1 with a compressive load being applied.
Figure 6A:
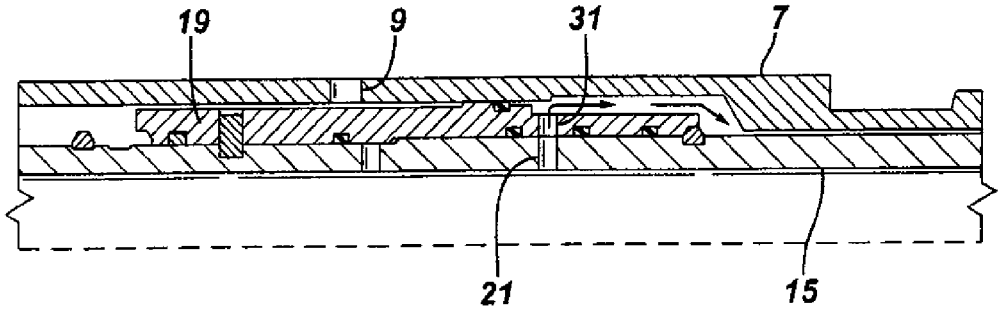
FIGS. 6A-D are schematic longitudinal cross sectional views of a portion of the base structure of the zonal isolation tool of FIG. 1 illustrating an operational sequence.
Figure 6B:
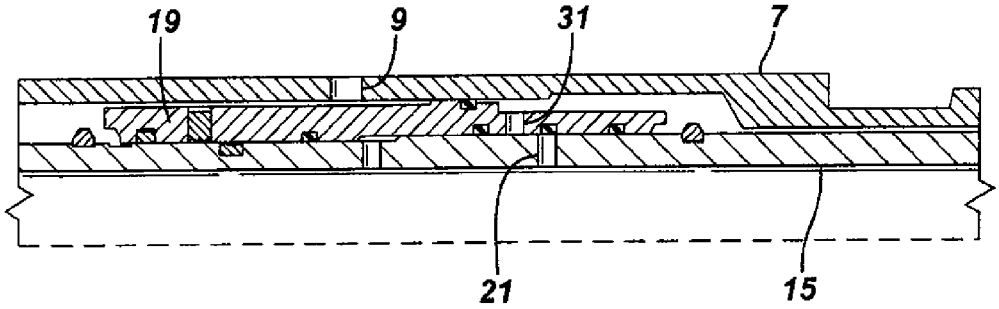
Figure 6C:
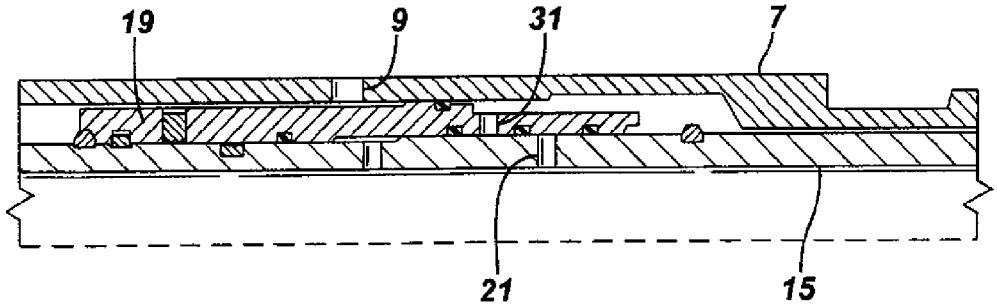
Figure 6D:
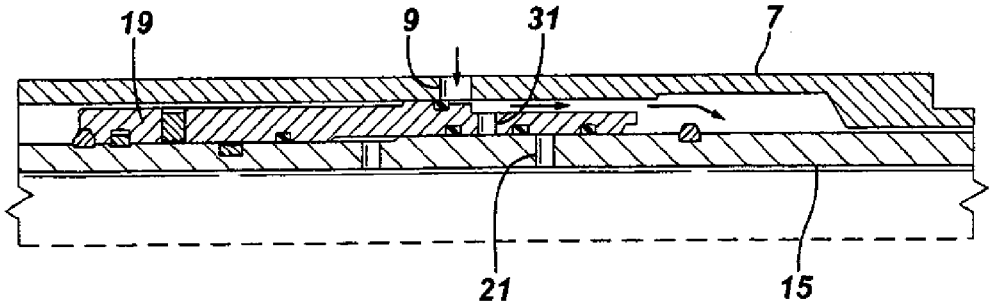

Referring now to FIGS. 3, 4 and 5, a first apparatus embodiment 29 of the invention is disclosed. The drawings are schematic in fashion and not to scale. The same numerals are used to call out similar components. This embodiment includes an elastomeric seal member 34 initially inflated by a fluid entering an inflation port 21 in base pipe 15. Inflation port 21 aligns with a similar passage 31 in a member 19, which may be described as an inflation valve, during initial expansion of seal member 34. Member 19, along with a moveable piston 13 and a movable sleeve 7 also define an expandable chamber 2. Moveable sleeve 7 includes a through hole 9, whose function will become apparent. Base pipe 15 includes another through passage 11 opening into a chamber 23 formed in a stationary sleeve 5. Moveable piston 13 is able to slide longitudinally downward within stationary sleeve 5. Passage 31 opens into a large chamber 43 able to accept fluid to expand sealing member 34. Chamber 43 is sealed by an o-ring or other seal at 39.

Figure 13:
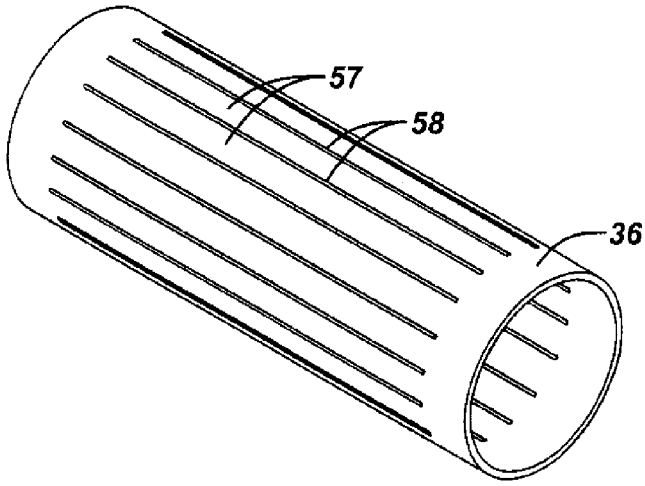
FIG. 13 is a perspective schematic view of the structural undercarriage of the zonal isolation tool of FIG. 1.

FIGS. 4 and 5 illustrate operation of embodiment 29. Sealing member 34 is initially expanded via fluid pressure entering through inflation port 21 and passage 31 and into chamber 43 to an initial expansion pressure, causing sealing member 34 to engage a wellbore or borehole wall 33. During this initial expansion, moveable piston 13 and moveable sleeve 7 remain essentially stationary. Once the defined initial pressure is reached in chamber 43, member 19 moves to the left, blanking or closing inflation port 21, and through hole 9 opens into the hydroforming chamber 43, as illustrated in FIG. 5. After inflation port 21 is blanked off or closed, a fluid 45 is introduced into chamber 23 via through hole 11, causing moveable piston 13 and moveable sleeve 7 to the right in FIG. 5. This in turn causes sealing member 34 to compress axially and also to form a seal at or near a leading edge 32. Fluid pressure 35A is also allowed to vent from the annulus 6 into chamber 43 through passage 9 and pressure 35B is nearly equal to pressure 35A, allowing pressure communication as indicated by the arrows from annulus 6 to chamber 43. Pressures 35A and 35B are higher than pressure 37. Sealing member 34 (FIG. 5) may include an underlying carriage 36 (FIG. 13). After actuation, differential pressure energizes the cup-type seal 34, vis-à-vis pressure in 35B is greater than pressure in 37. It should be noted that the fluid pressure used to activate the sealing member 34 may be transmitted to the sealing member 34 and/or setting pistons 13 by various means. An embodiment receives the tubing pressure via a setting tool 28 fitted with sealing elements (o-rings, packing, or the like). When the sealing members 34 are situated in polished bores both above and below the zonal isolation tool 29 or packer system, a pressure chamber is formed that communicates with the packer element and setting pistons 13. Pressure is applied thru the setting tool 28 via the surface control equipment at the rig. Another embodiment utilizes the differential pressure between the hydrostatic pressure downhole and a trapped atmospheric chamber (not shown) integral to the packer device. To activate the packer, a setting tool is used to break the seal of the atmospheric trap chamber. Once freed, the pressure differential may be used to hydroform the element, and further to apply the compressive load as claimed. A similar embodiment may compliment or even replace the trapped atmospheric chamber with a pre-charged volume of nitrogen or other gas stored within the packer. The result is to create a large differential pressure at setting depth. Further embodiments may include activation by non pressurizing means, such as mechanical ratcheting via an electric-powered or hydraulic-powered downhole device, such as a tractor run on slickline, e-line, or coiled tubing.

The zonal isolation tool 29 of this embodiment uses hydroforming pressure as a first step to energize. Initial inflation will affect a long length of sealing contact, assuring good compliance to the open hole. After initial inflation, a compressive load is applied via linear piston 7 (FIG. 5) to ensure sealing point 32 near the leading end of the sealing element structure.

The following are operational considerations, occurring sequentially: (1) the tubing or base pipe 15 must be open to the sealing member; (2) the initial inflation must stop when a defined pressure within sealing member 34 is reached; (3) inflation port 21 must be assuredly blanked from tubing or base pipe 15; and (4) a vent must open between sealing member 34 and annulus 6. As illustrated in FIGS. 3-5, in certain embodiments of the invention a linear compressive load from a moveable piston opens a vent such as passage 9 in FIG. 5. The operational sequence must happen in the proper order. FIGS. 6A-D illustrate this order. For example, if vent 9 is opened prior to port 21 being blanked, then it would become impossible to blank port 21 because open communication would be established. To blank the port 21, an o-ring must un-seal, then re-seal under dynamic conditions. Despite that limitation, other combinations of this sequence may work in other embodiments of the invention, as disclosed herein.

Figure 1:
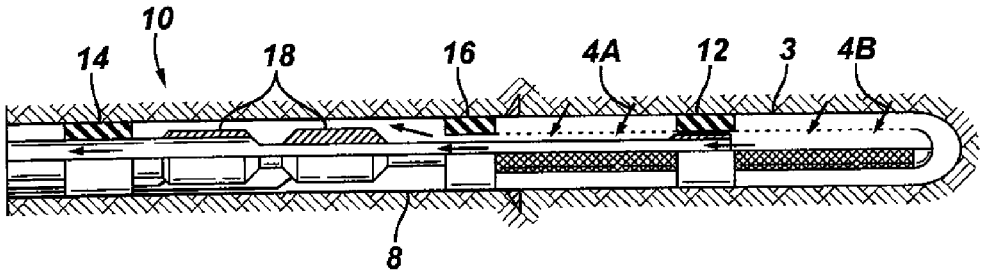
FIG. 1 (Prior Art)
FIG. 1 is a schematic side elevation view, partially in longitudinal cross section, of a completion assembly comprising an embodiment of a zonal isolation tool constructed in accordance with the invention.
Figure 2:
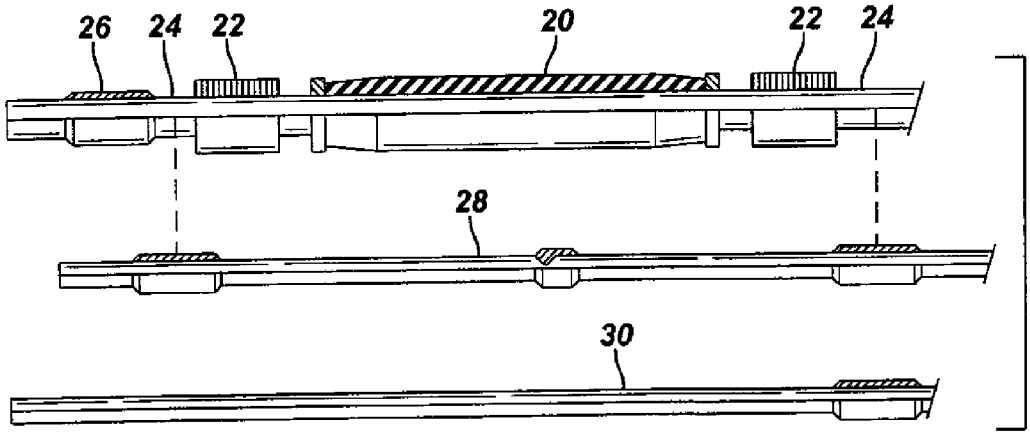
FIG. 2 (Prior Art)
FIG. 2 is a schematic side elevation view, partially in longitudinal cross section, of the zonal isolation tool of FIG. 1, along with a setting string and isolation string.
Figure 7:
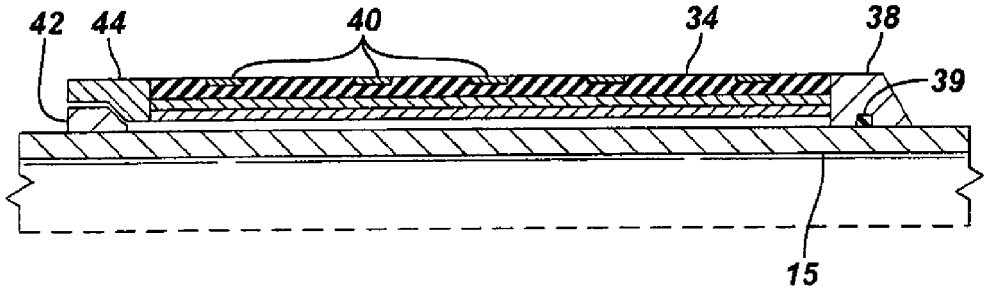
FIG. 7 is a schematic longitudinal cross section view of a portion of the zonal isolation tool of FIG. 1 illustrating the seal element.

Referring to FIG. 7, several circumferential bands 40 may be employed to prevent seal 34 from expanding radially while running in hole. FIG. 7 illustrates schematically a simplified seal 34 with bands 40. The right end 38 of seal 34 is fixed while the left end 44 is free to displace axially to the right. A ratchet ring 42 prevents axial movement to the left and thus helps seal 34 retain elastic (potential) energy. Setting pressure is applied inside seal 34 via the packer setting tool 28 (FIG. 2). Bands 40 break when a defined pressure is reached, allowing seal 34 to expand and contact the formation wall 33 (FIGS. 4, 5). Another embodiment of this feature may replace or complement the circumferential bands with a poppet valve.

Figure 8:
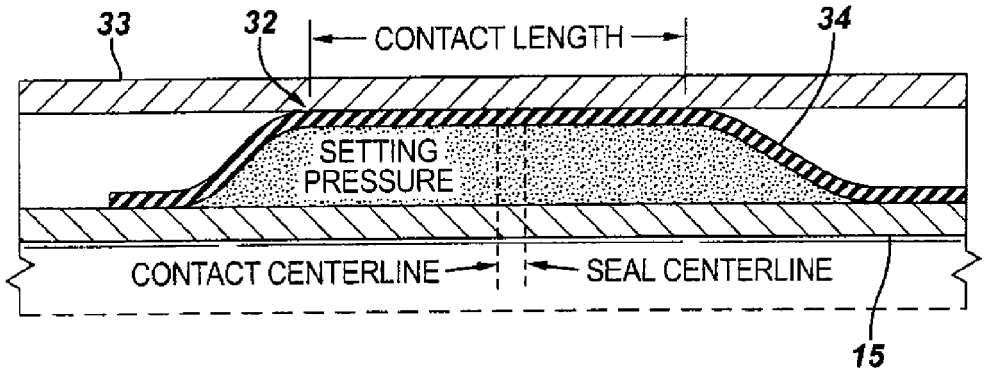
FIG. 8 is a schematic longitudinal cross section view of a portion of the zonal isolation tool of FIG. 1 illustrating the seal element after inflation pressure.
Figure 12:
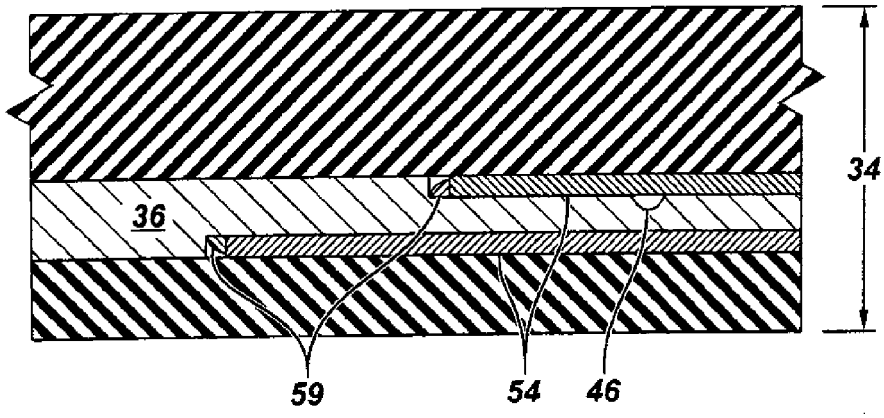
FIG. 12 is an enlarged schematic longitudinal cross section view illustrating anti-extrusion sheets used in the zonal isolation tool of FIG. 14.

As illustrated in FIG. 8, the seal centerline in this embodiment lies to the right of the contact centerline. This behavior is conditioned by machining a notch 46 at the left end of carriage 36 (FIG. 12).

Figure 9:
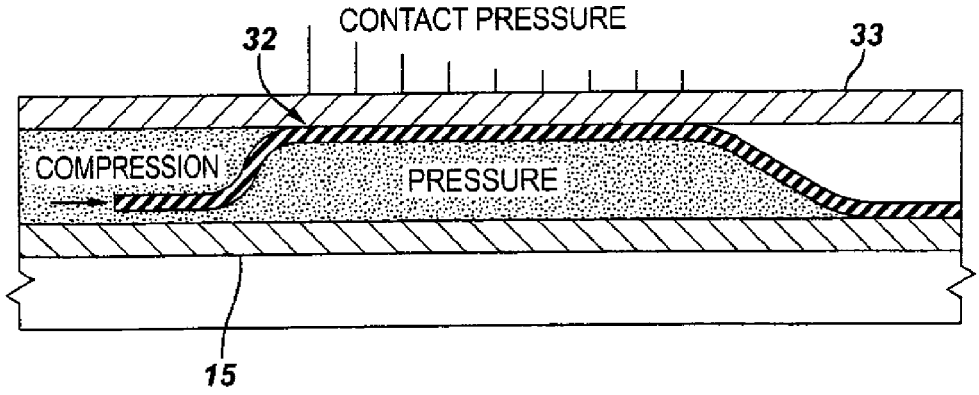
FIG. 9 is a schematic longitudinal cross section view of a portion of the zonal isolation tool of FIG. 1 illustrating the seal element after compressive loading is applied.

A setting pressure of approximately 1,500 psi (about 10.3 megaPascals) is used to lengthen the contact length of seal 34 with the formation (FIG. 8). Finally, the setting pressure is increased to approximately 2,500 psi (about 17.2 megaPascals) to: (1) blank port 21 (i.e. isolate inside of sealing member 34 from tubing or base pipe 15 pressure); (2) vent sealing member 34 to annulus 6 through vent 9; and (3) axially compress the left end of sealing member 34 to bias sealing point 32. The cup effect makes each seal unidirectional, as illustrated in FIG. 9. When a bidirectional seal is desired, at least two seals are required facing opposite directions.

Figure 10:
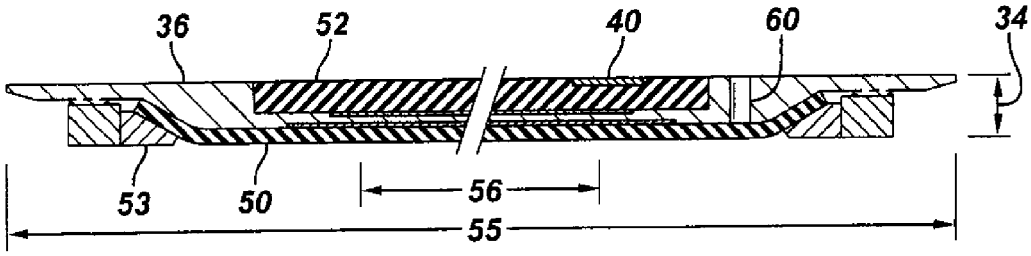
FIG. 10 is a more detailed schematic longitudinal cross section view of the seal element of the zonal isolation tool of FIG. 1.

A venting port 60 (FIG. 10) may be placed on the low-pressure side 37 of sealing member 34 to eliminate any atmospheric trap that would be created between the inner sealing element 50 outer sealing element 52. Total seal length is indicated at 55, while slotted length is indicated at 56 if a slotted carriage is employed.

Carriage 36 is illustrated in FIG. 13 as a cylinder having one or more machined slots 58 in the axial direction. These slots may be used to create individual beams 57 around the cylinder. The left end of beams 57 may be notched as illustrated in detail in FIG. 12 to simulate a "simply supported" beam. The right end may not be notched; if it is not, the right end simulates a "cantilevered" beam. Carriage 36 may also be un-slotted, that is, a thin solid tube.

Inner sealing element 50 (FIG. 11), sometimes referred to as a bladder, may be an elastomeric cylinder bonded near the ends of carriage 36 to provide inflation capability to sealing member 34. Inner sealing element 50 allows sealing member 34 to deploy under internal pressure and to self-energize when differential pressure across packer 20 is present. Because inner sealing element 50 may be cold-bonded to metal at 51, a mechanically energized wedge 53 may be used to improve reliability. Inner sealing element 50 may have a thickness ranging from about 0.10 to about 0.20 inch (from about 0.25 to about 0.5 cm), and may comprise 80 durometer HNBR, although the invention is not so limited, as other materials discussed herein may be employed.

Outer sealing element 52 may be a rubber cylinder bonded to the ends of the carriage 36 to provide sealing against the formation. Outer sealing element 52 may have any thickness that provides appropriate tear and wear resistance during conveyance and good conformability to open-hole irregularities. Its thickness may range from about 0.30 to about 0.70 inch (from about 0.76 to about 1.78 cm) to. Outer seal element 52 may also comprise 80 durometer HNBR, and may comprise other materials as discussed herein.

Figure 11:
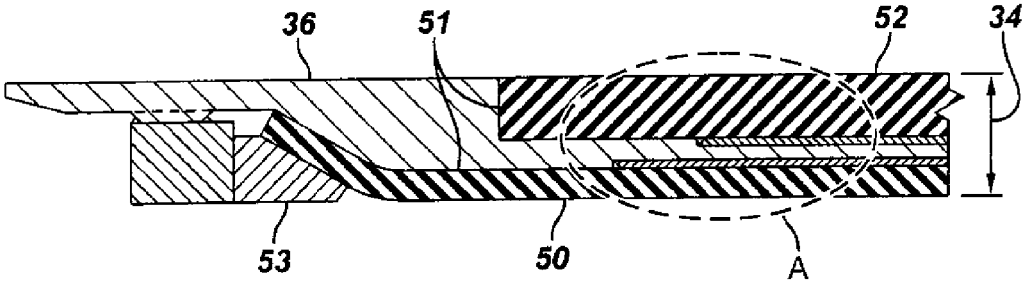
FIG. 11 is an enlarged detailed view of a portion of the seal element of the zonal isolation tool of FIG. 1.

Dashed circle "A" in FIG. 11 refers to a detailed view illustrated in FIG. 12. The use of notched beams in support carriage 36 helps control the axial location of the leading edge 32 of the contact point of sealing member 34 with the formation. By allowing some degree of enhanced freedom in radial movement in or near the notched end 46, the maximum deflection point (contact point with maximum sealing pressure) shifts to the left of the structure, as illustrated schematically in FIGS. 8 and 9. This improves the overall sealing performance of sealing elements 50 and 52 under differential pressure and contributes to the long-term reliability of the apparatus of the invention, particularly sealing member 34. Additionally, individual beams 57 able to expand radially may be more efficient than a continuous metallic cylinder in terms of pressure required to achieve a given expansion and in terms of conforming to irregular open hole geometries. Carriage 36 may be made of, for example, 4130/4140 steel.

Anti-extrusion sheets 54 (FIG. 12) are, in the embodiment illustrated, sheet metal cylinders located between carriage 36 and outer sealing element 52 and inner bladder 50 to prevent extrusion through the gaps formed as individual beams 57 in carriage 36 expand and separate. Anti-extrusion sheets 54 may be slotted or un-slotted, and may have any thickness suitable for the intended purpose, but will likely range in thickness from about 0.020 to about 0.050 inch (from about 0.051 to about 0.13 cm). Anti-extrusion sheets may comprise half-hardness low-carbon steel, and if used are welded at 59 to carriage 36 at each end. Un-slotted anti-extrusion sheets may allow removal of inner elastomeric element 50 and a buffer layer. A buffer layer of non-metallic material may be added between the innermost anti-extrusion sheet metal cylinder 54 and inner elastomeric element 50. A buffer layer may be used to prevent the sharp edges of the sheet metal cylinder from puncturing the relatively thin layer of elastomer used for inner elastomeric member 50. Suitable buffer layer materials include polyetheretherketone (PEEK), and may be have a thickness ranging from about 0.010 to about 0.030 inch (about 0.025 to about 0.076 cm).

Figure 14A:
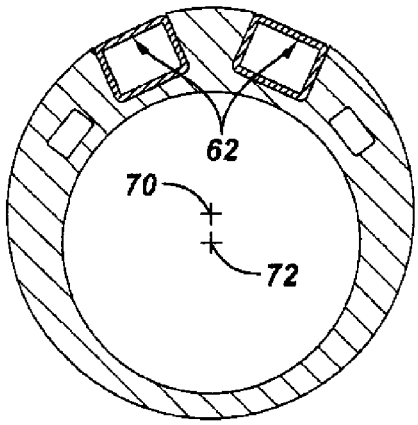
FIGS. 14A and 14B are schematic axial cross section views illustrating alternate fluid pathways that may be incorporated in the zonal isolation tool of FIG. 1.
Figure 14B:
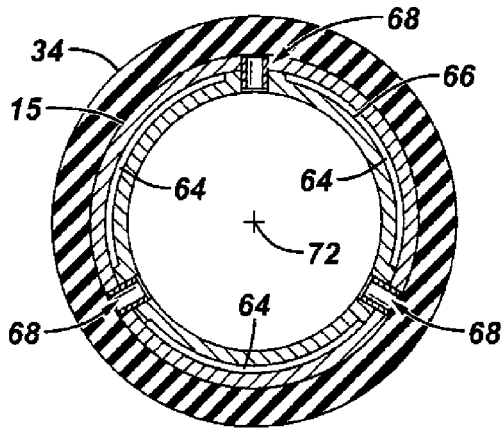

FIGS. 14A and 14B illustrate schematic cross section views at a screen pipe (FIG. 14A) and a packer (FIG. 14B) of one embodiment of the invention. FIG. 14A illustrates shunt tubes 62 for pumping gravel slurry or injection fluids through a zonal isolation tool of the invention, and illustrates that the outer circumference of the screen may have a different center 70 than the inner circumference 72. FIG. 14B illustrates alternate fluid pathways for pumping gravel slurry or injection fluids through a zonal isolation tool of the invention. Three pathways 64 illustrated between a screen base pipe 66 and a packer base pipe 15, along with three packer setting ports 68. Maintaining a sufficiently large inner diameter is desirable to achieving full functionality for such alternate fluid pathways. The design illustrated preserves an equivalent area from for transport tubes. It is possible to move the packer and screen base pipes onto different centers, which would ease the disruption in the flow transition.

Figure 15A:
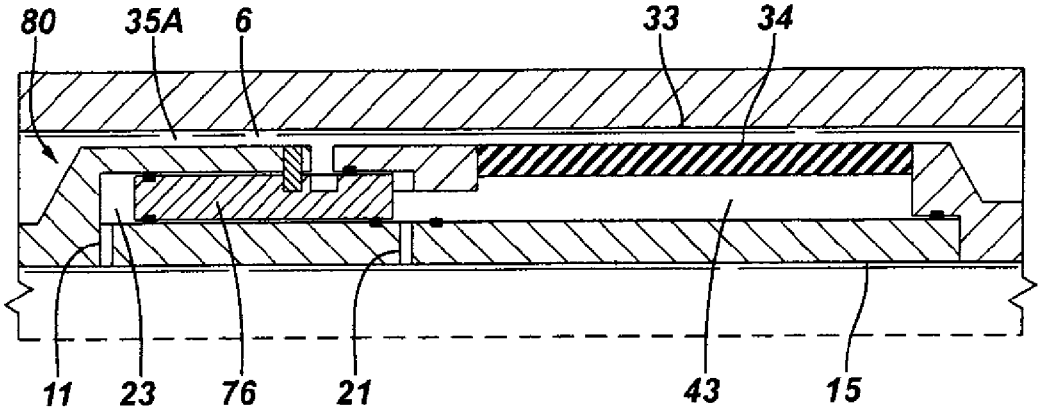
FIGS. 15A, 15B, and 15C are schematic longitudinal cross section views of another embodiment of a zonal isolation tool of the invention.
Figure 15B:
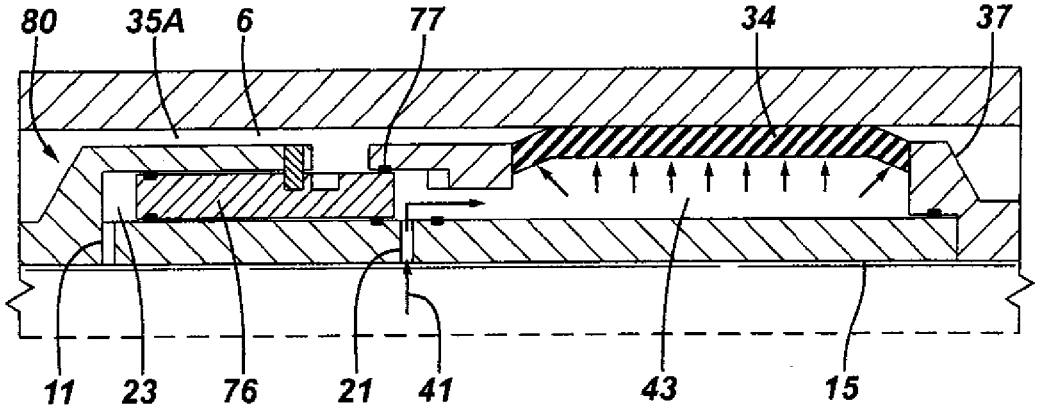
Figure 15C:
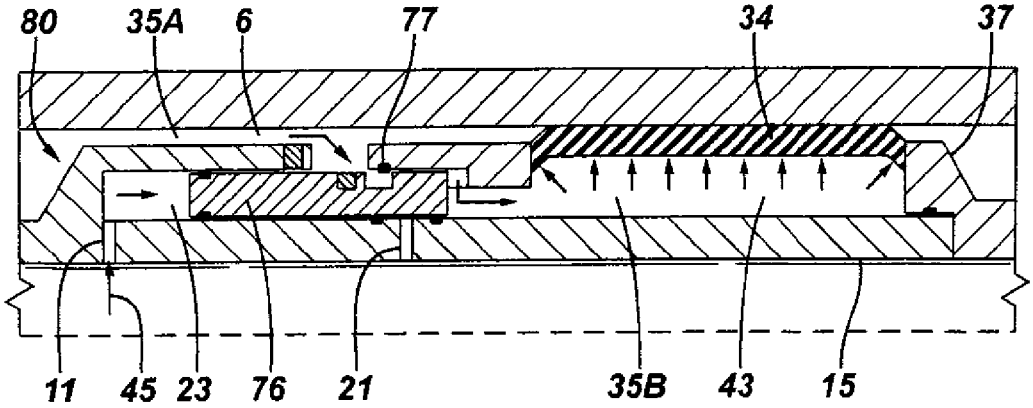

FIGS. 15A, 15B, and 15C illustrate schematically an alternate embodiment of the invention 80. This embodiment differs from embodiment 29 illustrated in FIGS. 3-5 in operation. After initial seal pressure is reached in chamber 43 using fluid 41, a moveable block 76 is moved to the right by fluid pressure 45, and an O-ring 77 is caused to unseat into a small chamber 78. In the same movement, inflation port 21 is blanked close, and high pressure fluid in annulus 6 is allowed to pass through chamber 78 into chamber 43, causing the pressures 35A and 35B to become nearly equivalent. Since there is no passage in block 76 to align with inflation port 21 in base pipe 15, there is less chance in this embodiment that annulus pressure will pass through port 21, and port 21 is more easily blanked.

Apparatus of the invention may be used in an open hole for sandface completions utilizing stand-alone screens. However, the inventive apparatus may also be adapted for use in open-hole gravel pack sand control applications. In the latter role, the inventive apparatus may incorporate the use of alternate path transport and shunt tubes to assist gravel slurry placement. Additionally, the inventive apparatus may be used in sand control applications utilizing expandable screens. Aside from the various sand control applications listed, the inventive apparatus may also be used as an annular barrier, or for compartmentalizing long open-hole sections.

The zonal isolation tools of the invention may connect in any number of ways to their wellbore counterparts. Each end of the apparatus of the invention may be adapted to be attached in a tubular string. This can be through threaded connections, friction fits, expandable sealing means, and the like, all in a manner well known in the oil tool arts. Although the term tubular string is used, this can include jointed or coiled tubing, casing or any other equivalent structure for positioning tools of the invention. The materials used can be suitable for use with production fluid or with an inflation fluid.

The outer elastomeric elements engage an adjacent surface of a well bore, casing, pipe, tubing, and the like. Other elastomeric layers between the inner and outer elastomeric members may be provided for additional flexibility and backup. A non-limiting example of an elastomeric element is rubber, but any elastomeric materials may be used. A separate membrane may be used with an elastomeric element if further wear and puncture resistance is desired. A separate membrane may be interleaved between elastomeric elements if the elastomeric material is insufficient for use alone. The elastomeric material of outer sealing elements should be of sufficient durometer for expandable contact with a well bore, casing, pipe or similar surface. In some embodiments the elastomeric material may be of sufficient elasticity to recover to a diameter smaller than that of the wellbore to facilitate removal therefrom. The elastomeric material should facilitate sealing of the well bore, casing, or pipe in the inflated state.

"Elastomer" as used herein is a generic term for substances emulating natural rubber in that they stretch under tension, have a high tensile strength, retract rapidly, and substantially recover their original dimensions (or even smaller in some embodiments). The term includes natural and man-made elastomers, and the elastomer may be a thermoplastic elastomer or a non-thermoplastic elastomer. The term includes blends (physical mixtures) of elastomers, as well as copolymers, terpolymers, and multi-polymers. Examples include ethylene-propylene-diene polymer (EPDM), various nitrile rubbers which are copolymers of butadiene and acrylonitrile such as Buna-N (also known as standard nitrile and NBR). By varying the acrylonitrile content, elastomers with improved oil/fuel swell or with improved low-temperature performance can be achieved. Specialty versions of carboxylated high-acrylonitrile butadiene copolymers (XNBR) provide improved abrasion resistance, and hydrogenated versions of these copolymers (HNBR) provide improve chemical and ozone resistance elastomers. Carboxylated HNBR is also known. Other useful rubbers include polyvinylchloride-nitrile butadiene (PVC-NBR) blends, chlorinated polyethylene (CM), chlorinated sulfonate polyethylene (CSM), aliphatic polyesters with chlorinated side chains such as epichlorohydrin homopolymer (CO), epichlorohydrin copolymer (ECO), and epichlorohydrin terpolymer (GECO), polyacrylate rubbers such as ethylene-acrylate copolymer (ACM), ethylene-acrylate terpolymers (AEM), EPR, elastomers of ethylene and propylene, sometimes with a third monomer, such as ethylene-propylene copolymer (EPM), ethylene vinyl acetate copolymers (EVM), fluorocarbon polymers (FKM), copolymers of poly(vinylidene fluoride) and hexafluoropropylene (VF2/HFP), terpolymers of poly(vinylidene fluoride), hexafluoropropylene, and tetrafluoroethylene (VF2/HFP/TFE), terpolymers of poly(vinylidene fluoride), polyvinyl methyl ether and tetrafluoroethylene (VF2/PVME/TFE), terpolymers of poly(vinylidene fluoride), hexafluoropropylene, and tetrafluoroethylene (VF2/HPF/TFE), terpolymers of poly (vinylidene fluoride), tetrafluoroethylene, and propylene (VF2/TFE/P), perfluoroelastomers such as tetrafluoroethylene perfluoroelastomers (FFKM), highly fluorinated elastomers (FEPM), butadiene rubber (BR), polychloroprene rubber (CR), polyisoprene rubber (IR), IM, polynorbornenes, polysulfide rubbers (OT and EOT), polyurethanes (AU) and (EU), silicone rubbers (MQ), vinyl silicone rubbers (VMQ), fluoromethyl silicone rubber (FMQ), fluorovinyl silicone rubbers (FVMQ), phenylmethyl silicone rubbers (PMQ), styrene-butadiene rubbers (SBR), copolymers of isobutylene and isoprene known as butyl rubbers (IIR), brominated copolymers of isobutylene and isoprene (BIIR) and chlorinated copolymers of isobutylene and isoprene (CIIR).

The expandable portions of the packers of the invention may include continuous strands of polymeric fibers cured within the matrix of the integral composite body comprising elastomeric elements. Strands of polymeric fibers may be bundled along a longitudinal axis of the expandable packer body parallel to longitudinal cuts in a laminar interior portion of the expandable body. This can facilitate expansion of the expandable portion of the composite body yet provide sufficient strength to prevent catastrophic failure of the expandable packer upon complete expansion.

The expandable portions of the inventive tools may also contain a plurality of overlapping reinforcement members. These members may be constructed from any suitable material, for example high strength alloys, fiber-reinforced polymers and/or elastomers, nanofiber, nanoparticle, and nanotube reinforced polymers and/or elastomers, or the like, all in a manner known and disclosed in U.S. patent application Ser. No. 11/093,390, filed on Mar. 30, 2005, entitled "Improved Inflatable Packers", the entirety of which is incorporated by reference herein.

Zonal isolation tools of the invention may be constructed of a composite or a plurality of composites so as to provide flexibility. The expandable portions of the inventive tools may be constructed out of an appropriate composite matrix material, with other portions constructed of a composite sufficient for use in a wellbore, but not necessarily requiring flexibility. The composite may be formed and laid by conventional means known in the art of composite fabrication. The composite may be constructed of a matrix or binder that surrounds a cluster of polymeric fibers. The matrix can comprise a thermosetting plastic polymer which hardens after fabrication resulting from heat. Other matrices are ceramic, carbon, and metals, but the invention is not so limited. The matrix can be made from materials with a very low flexural modulus close to rubber or higher, as required for well conditions. The composite body may have a much lower stiffness than that of a metallic body, yet provide strength and wear impervious to corrosive or damaging well conditions. The composite tool body may be designed to be changeable with respect to the type of composite, dimensions, number of cable and fibrous layers, and shapes for differing downhole environments.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, no clauses are intended to be in the means-plus-function format allowed by 35 U.S.C. § 112, paragraph 6 unless "means for" is explicitly recited together with an associated function. "Means for" clauses are intended to cover the structures described herein as performing the recited function and not only structural equivalents, but also equivalent structures.

What is claimed is:

1. An apparatus comprising:

a wellbore sealing member expandable by fluid pressure to contact a wellbore over an initial contact area;

an inflation valve open during expansion of the sealing member to the initial contact area and closed upon the fluid pressure reaching a predetermined setting;

a vent between the sealing member and a wellbore annulus adapted to open after the inflation valve is closed; and a mechanism to control the longitudinal location of a leading edge of a final seal to ensure a sealing point at or near a leading edge of the wellbore sealing member.

2. The apparatus of claim 1 wherein the mechanism to control longitudinal location comprises a slotted member selected from a metal slotted cylindrical member and a composite slotted cylindrical member, the slotted member having a plurality of individual beams, at least some of the beams having notches near the leading edge of the sealing member to simulate simply supported beams; and further comprising one or more anti-extrusion members selectively positioned between the slotted cylindrical member and the inner sealing element, or between the slotted cylindrical member and the outer sealing element, or in both positions.

3. An apparatus comprising:

a) a wellbore sealing member inflatable by fluid pressure to contact a wellbore over an initial contact area and compressible by an axial load, the wellbore sealing member comprising an inner sealing element and an outer sealing element;

b) an inflation valve open during inflation of the sealing member and closed upon the fluid pressure reaching a predetermined setting;

c) a vent between the sealing member and a wellbore annulus adapted to open after the inflation valve is closed; and d) a compression member adapted to produce the axial load on the wellbore sealing member to form a sealing point at or near a leading edge of the wellbore sealing member.

4. The apparatus of claim 3 wherein the one or both of the inner and outer sealing elements, or portions of each, comprise an elastomeric material, which may be the same or different for each member or portion thereof.

5. The apparatus of claim 3 comprising means for preventing substantial radial expansion of the wellbore sealing member while running the apparatus in hole.

6. The apparatus of claim 3 further comprising a means for controlling longitudinal location comprising a slotted member selected from a metal slotted cylindrical member and a composite slotted cylindrical member, the slotted member having a plurality of individual beams, at least some of the beams having notches near the leading edge of the sealing member to simulate simply supported beams.

7. The apparatus of claim 3 comprising one or more anti-extrusion members selectively positioned between the slotted cylindrical member and the inner sealing element, or between the slotted cylindrical member and the outer sealing element, or in both positions.

8. A method comprising a) positioning a zonal isolation tool in a wellbore between two zones, the zonal isolation tool comprising i) a wellbore sealing member expandable by fluid pressure to contact a wellbore over an initial contact area;

ii) an inflation valve open during expansion of the sealing member to the initial contact area and closed upon the fluid pressure reaching a predetermined setting; and iii) a vent between the sealing member and a wellbore annulus adapted to open after the inflation valve is closed;

b) inflating the wellbore sealing member to establish an initial sealing area;

c) axially compressing the wellbore sealing member to achieve a final seal having a point at or near a leading edge of the sealing member.

9. The method of claim 8 comprising beginning axial compression of the wellbore sealing element before beginning venting of the wellbore sealing member to the wellbore annulus.

10. The method of claim 8 comprising beginning axial compression of the wellbore sealing element before closing the inflation valve completely, followed by the venting the wellbore sealing element to the wellbore annulus.

11. The method of claim 8 comprising producing fluid from at least one of the two zones.

12. The method of claim 8 comprising producing two different fluids from the two zones.

13. The method of claim 8 wherein the inflating comprises initially hydroforming the wellbore sealing member with a surface pump or other pressurizing means through a tubing connected to the wellbore sealing member and then de-pressurizing though the tubing to form an initially sealed wellbore sealing member.

* * * * *